United States Patent [19]

Kawasaki et al.

[11] Patent Number: 4,656,763

[45] Date of Patent: Apr. 14, 1987

[54] STEAM IRON WITH STEAM SURGE GENERATION CAPABILITY

[75] Inventors: Kazuhisa Kawasaki, Kyoto; Yoshiyuki Ujino, Nishinomiya; Takahisa Tsuji; Tsuneo Saeki, both of Osaka, all of Japan

[73] Assignee: Matsushita Electric Industrial Co., Ltd., Japan

[21] Appl. No.: 817,592

[22] Filed: Jan. 10, 1986

[30] Foreign Application Priority Data

Jan. 11, 1985 [JP] Japan ..... 60-3543

[51] Int. Cl.[4] ..... D06F 75/18

[52] U.S. Cl. ..... 38/77.83; 38/77.7; 38/77.8; 38/77.3

[58] Field of Search ..... 219/273; 38/77.7, 77.83, 38/77.8, 77.9, 77.81, 77.3

[56] References Cited

U.S. PATENT DOCUMENTS

| | | | |
|---|---|---|---|
| 2,620,576 | 12/1952 | Stevenson et al. | 38/77.83 |
| 2,782,537 | 2/1957 | Vera-Mege | 38/77.83 |
| 3,165,843 | 1/1965 | Willman | 38/77 |
| 3,919,793 | 11/1975 | Toft et al. | 38/77.83 |
| 3,986,282 | 10/1976 | Nelson | 38/77.83 |
| 4,107,860 | 8/1978 | Coggiola | 38/77.83 |
| 4,125,953 | 11/1978 | Colombo | 38/77.7 |
| 4,203,026 | 5/1980 | Walter et al. | 219/273 X |
| 4,578,884 | 4/1986 | Naikao | 38/77.83 |

FOREIGN PATENT DOCUMENTS

| | | | |
|---|---|---|---|
| 560081 | 7/1958 | Canada | 38/77.83 |
| 42-15590 | 8/1967 | Japan . | |
| 48-36719 | 11/1973 | Japan . | |
| 53-24497 | 3/1978 | Japan . | |

*Primary Examiner*—Henry S. Jaudon
*Assistant Examiner*—Andrew M. Falik
*Attorney, Agent, or Firm*—Lowe, Price, LeBlanc, Becker & Shur

[57] ABSTRACT

A steam iron having a removable water tank from which water is supplied to a steam generating chamber disposed in the soleplate of the iron, with steam generated thereby being ejected through apertures in the lower face of the soleplate, has a plurality of operating modes. In steam ironing mode, water is supplied continuously at a specific limited flow rate to the steam generating chamber through a water passage from the water tank. A pump mechanism communicating with the water passage is actuatable for supplying a momentary surge of water into the steam generating chamber for generating a surge of steam, and includes a reverse flow prevention valve which operates during each surge generation. Selection of the steam ironing mode, steam surge generation, or a dry ironing mode, is performed by actuation of a single operating pushbutton which is disposed at the front end of the handle of the iron.

6 Claims, 5 Drawing Figures

STEAM IRON WITH STEAM SURGE GENERATION CAPABILITY

BACKGROUND OF THE INVENTION

The present invention relates to an improved form of steam iron, having a water tank from which water can be supplied to a steam generating chamber to be rapidly vaporized therein with the steam thus generated being ejected through apertures in the soleplate of the iron onto a material which is being ironed.

More specifically, the invention is directed towards an improved steam iron of this type, which enables convenient selection of each of a plurality of operating modes. These are, respectively, an operation mode in which water is continuously admitted to the steam generating chamber at a limited fixed flow rate, for continuous steam generation, a mode of operation in which a momentary flow of a large quantity of water into the steam generating chamber is executed to produce a surge of steam from the iron, and a mode of operation in which no steam is generated.

Generally, a steam iron has the steam generating chamber formed in the soleplate, which is heated by an electric heating element, and water is supplied to the steam generating chamber from the water tank through a nozzle having a small-diameter aperture formed therein. A valve mechanism is normally incorporated, which is actuatable by the user to select either a steam ironing mode of operation or a dry ironing mode of operation.

In the case of a steam iron which also has a steam surge generating capability, a momentary surge of steam can be ejected through apertures formed in the soleplate of the iron, onto the material which is being ironed, in order to flatten out wrinkles in the material, when such wrinkles are excessively difficult to remove by the normal steam ironing mode of operation.

A prior art example of a steam iron having a steam surge generating capability is disclosed in Japanese Pat. No. 48-36719, and another example in U.S. Pat. No. 4,107,860. According to these patents, the steam iron is provided with a pump mechanism which is separate from the nozzle leading into the steam generating chamber as mentioned above, i.e. the nozzle which is also incorporated in a conventional type of steam iron. Separate external operating members are provided, which are actuatable by the user for controlling the operation of the pump mechanism and the opening and closing of the nozzle, respectively, i.e. at least two separate operating members are employed for selecting the steam and dry ironing modes of operation and for generating a surge of steam when desired. These two external operating members are mounted at the forward end of the handle of the steam iron. Thus with such a prior art type of steam iron it is necessary to provide at least three external operating members, i.e. one member for enabling selection of steam ironing and dry ironing modes of operation, one member for producing a momentary surge of steam when required, and one member for the user to adjust the temperature of the soleplate of the iron to a desired value. This necessity to provide a number of separate operating members renders it difficult for the user to operate the iron, and also, due to the concentration of these operating members (i.e. pushbuttons, knobs, etc) at one end of the handle of the iron, the design and manufacture of such a steam iron are difficult, e.g. because of the limited amount of space which is available at the front end of the handle of the iron.

In addition, in recent years, a new type of steam iron has been proposed, in which the water tank is removably mounted on the front end of the main body of the steam iron, in order to facilitate filling and emptying of the water tank. Such a steam iron is disclosed, for example, in Japanese Pat. No. 53-24497. This feature is extremely convenient for the user. However if such a feature were to be incorporated into a prior art type of steam iron having a steam surge generating capability, then the construction and manufacture would be extremely difficult, due to the various operating members which must be accommodated at the front end ofthe handle of the iron.

In order to overcome these problems, a configuration for a steam iron has been proposed whereby a single operating member, i.e. an operating pushbutton, is utilized both for selecting steam ironing and dry ironing modes of operation and also for generating a momentary surge of steam. An example of such a steam iron is disclosed in U.S. Pat. No. 2,782,537, and also in U.S. Pat. Nos. 3,165,843 and 3,986,282, in which a steam iron has a pump mechanism formed integrally with a nozzle which communicates with the steam generating chamber. However in the case of the steam iron of U.S. Pat. No. 2,782,537, the described construction is not suitable for practical manufacture. This is because the operating pushbutton for the pump mechanism is mounted at the rear end of the steam iron, and so it would be difficult for a user to actuate this pushbutton to generate a momentary sure of steam while moving the iron across the material being pressed. In addition, due to the fact that separate means are provided to constitute a reverse flow prevention valve for the latter pump mechanism, and to constitute means to implement changeover between dry ironing and steam ironing modes of operation, the mechanical configuration of such a steam iron is complex. Furthermore, due to the fact that the pump mechanism is disposed in the interior of the water tank, with the water intake aperture of the pump mechanism being higher than the base of the water tank, it is not possible to completely utilize all of the water contained in the water tank.

In the case of the steam iron disclosed in U.S. Pat. Nos. 3,165,843 and 3,986,282, a piston which is mounted for reciprocating movement within a cylinder of a pump mechanism also performs reciprocating movement within a water supply nozzle which supplies water to the steam generating chamber. Due to the fact that this nozzle is disposed at the base of the water tank and that the nozzle communicates directly with the cylinder of the pump mechanism, it is not possible to supply a large amount of water to the steam generating chamber by a single actuation of an operating pushbutton which is coupled to the piston of the pump mechanism. That is to say, only a limited volume of steam can be generated by a surge operation resulting from a single actuation of the latter operating pushbutton.

It can thus be understood that prior art types of steam iron designed to permit a surge of steam to be ejected momentarily when desired, present various serious disadvantages. In addition to these, the momentary supply of a surge of water into the steam generating chamber in order to produce a surge of steam will result in a sudden lowering of the temperature within the steam generating chamber, so that it is necessary to wait thereafter until this temperature has reached a sufficiently high value before generation of another surge of steam is initiated. In view of this, it has been proposed in the prior art to employ a temperature-sensitive cut-off unit in a conventional type of steam iron (i.e. a steam iron which does not include a steam surge generating capability) which will act to block the nozzle leading to the steam generating chamber, and thereby halt the supply of water to the steam generating chamber, when the temperature therein is not sufficiently high to result in instant generation of steam. Examples of such a steam iron are disclosed in Japanese Pat. No. 42-15590 and in U.S. Pat. No. 4,125,953. In the steam irons of these patents, one end of a bimetallic strip is attached to the solepate of the steam iron, and this bimetallic strip acts to open the nozzle (for supplying water to the steam generating chamber) when the temperature within the steam generating chamber is sufficiently high for generation of steam, and otherwise holds the nozzle in a closed condition. Such a temperature-sensitive cut-off device acts to limit the emission of steam in a manner tending to result in stable steam generation. However, it is even more desirable to employ such a temperature-sensitive cut-off unit in a steam iron which is capable of generating momentary surges of steam, with the amount of steam generated during each a surge being manually controllable by the user, since the momentary admission of a relatively large volume of water into the steam generating chamber in order to generate such a surge of steam will result in a temporary rapid drop in the temperature of the steam generating chamber. Thus, if no means are provided for blocking the further supply of water to the steam generating chamber in such a condition, further attempts by the user to generate a surge of steam will result only in hot water being ejected from the steam generating chamber through the apertures in the soleplate of the iron, thereby resulting in excessive dampening of the material being ironed.

SUMMARY OF THE INVENTION

It is an objective of the present invention to overcome the problems of prior art types of steam iron which are capable of generating momentary surges of steam. More specifically, it is a first objective of the present invention to provide a steam iron whereby water is normally supplied continuously to a steam generating chamber through a water passage which communicates between a water tank and the steam generating chamber and which includes a pump mechanism which communicates with the water passage, for momentarily supplying a large amount of water to the steam generating chamber in order to generate a surge of steam when desired by the user, and which further includes an operating pushbutton which is operable to actuate the pump mechanism for producing these surges of steam and which also is operable to selectively establish a steam ironing mode of operation and a dry ironing mode of operation of the iron. It is a feature of a steam iron according to the present invention that a large volume of steam can be generated by a single actuation of the operating pushbutton, and that the steam iron is extremely easy and convenient to use.

It is a second objective of the present invention to provide a steam iron capable of generating momentary surges of steam, having an operating pushbutton which can be set into three different positions, for respectively selecting a steam ironing mode of operation, a dry ironing mode of operation and generation of a surge of steam, and which is further provided with a restraint mechanism coupled to the operating pushbutton which renders it necessary for the user to exert a substantially higher amount of force upon the operating pushbutton in order to produce changeover from the steam ironing mode to the dry ironing mode, by comparison with the force required to initiate generation of a surge of steam. In this way, the danger of accidental locking of the iron in the dry ironing mode of operation, when attempting to generate successive surges of steam, is eliminated. This is an extremely convenient feature with regard to practical use of such a steam iron.

It is a third objective of the present invention to provide a steam iron capable of generating momentary surges of steam, which is provided with a water tank that is attached to the main body of the steam iron in a freely removable manner, to thereby facilitate filling and emptying of the water tank. Such a feature will greatly enhance the market appeal of such a steam iron.

It is a fourth objective of the present invention to provide a steam iron capable of generating momentary surges of steam, whereby the amount of water that can be supplied to the steam generating chamber of the iron as a result of successively repeated steam surge generation operation is automatically limited to an amount which will not exceed the steam generating capability of the steam generating chamber.

Other objectives and features of the present invention will become apparent from the following description of the preferred embodiment.

The essential features of a steam iron according to the present invention are as follows. With the iron set in a steam ironing mode of operation, water is supplied continuously at a regulated rate suitable for normal steam generation through a water passage which communicates between a water tank and a steam generating chamber. A pump mechanism communicates with this water passage, and actuation of an operating pushbutton coupled to this pump mechanism results in actuation of the pump to send a momentary surge of water into the steam generating chamber and also close the portion of the water passage leading between the water tank and the pump mechanism, thereby preventing reverse flow of water back to the tank when the pump mechanism is actuated.

DESCRIPTION OF THE PREFERRED EMBODIMENTS

Figure 1:
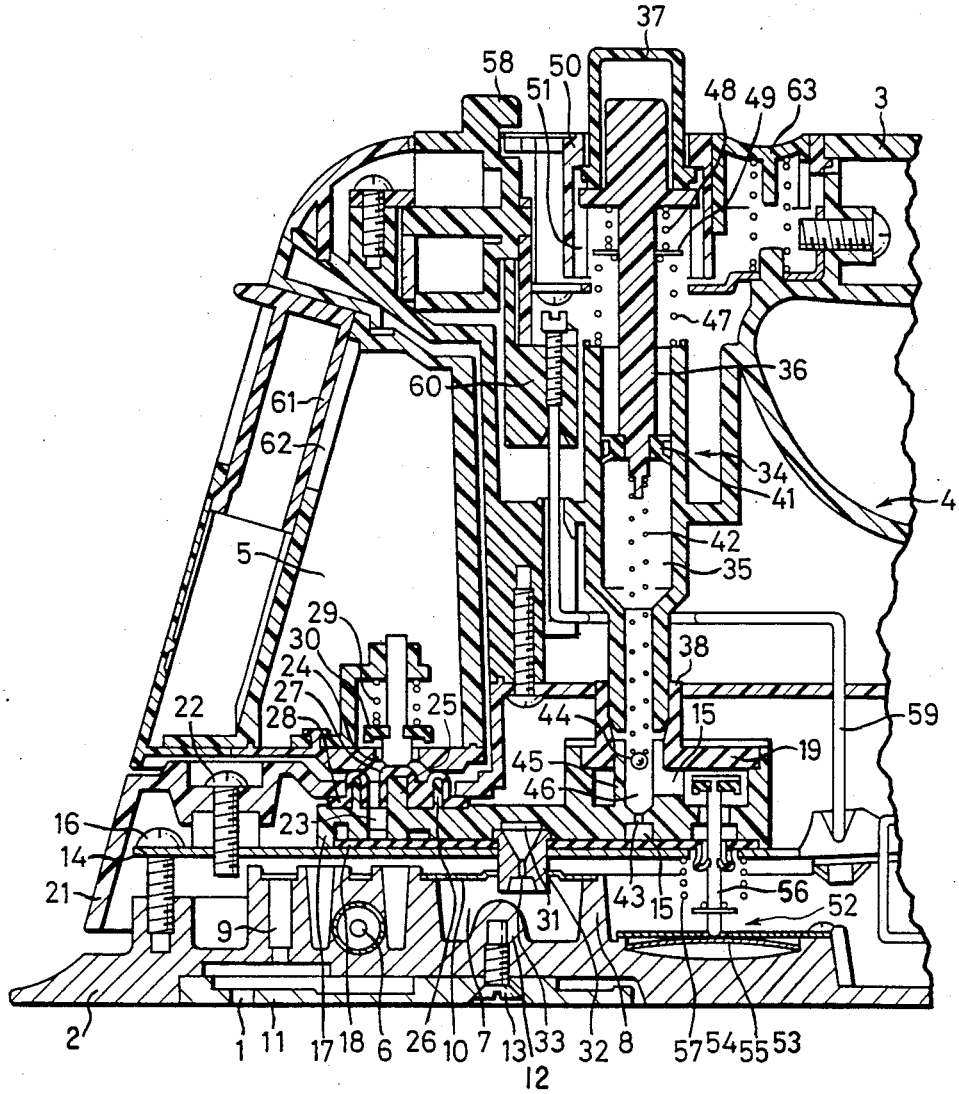
FIG. 1 is a side cross-sectional view of the front end of an embodiment of a steam iron according to the present invention.

Referring first to FIG. 1, the front end of an embodiment of a steam iron according to the present invention capable of generating momentary surges of steam is shown in partial cross-sectional side view. A plurality of steam ejection apertures 1 are formed in the soleplate 21 of the steam iron, with steam being output through steam ejection apertures 1 onto a cloth material which is being ironed. The main body 4 of the iron is mounted on the upper face of soleplate 2, and has a handle 3 attached thereto. A water tank 5 is attached in a freely removable manner to the steam iron at the front end of the main body 4 of the iron. The soleplate 2 is formed of an aluminum alloy, and has an electric heater element 6 embedded therein. The heater element 6 is of substantially U-shaped configuration as viewed in plan, with the ends thereof being positioned towards the rear end of soleplate 2. Reference numeral 7 denotes a steam generating chamber which is enclosed by heater element 6 and is partitioned from heater element 6 by a partitioning member 8. The steam generating chamber 7 communicates with apertures 1 through a steam passage 9. Numeral 10 denotes a cover which is sealed over the steam generating chamber 7 and steam passage 9. Reference numeral 11 denotes a base cover, which is attached to the lower face of soleplate 2 by means of a screw 13 which engages within a depression 12 formed in soleplate 2. In this way, the base cover 11 can be easily removed from the soleplate 2 in order to clean out the apertures 1 when these become blocked. Reference numeral 14 denotes a support plate, which serves to support components forming a water passage 15, described hereinafter, which supplies water from water tank 5 to steam generating chamber 7. The support plate 14 is attached by a screw 16 to the soleplate 2. The water passage 15 is formed between recesses formed in upper and lowr faces of a base member 17 and water passage covers 18 and 19 which cover the recesses formed in these lower and upper faces respectively, with water passage 15 being shaped such as to ensure a smooth flow of water therethrough. In this embodiment, the base member 17 is formed of a heat-resistant plastic material, however it would be equally possible to employ other types of material for this purpose. The water passage cover 18, which covers the recesses formed in the lower face of base member 17 is formed of a heat-resistant silicon rubber. In this way, with base member 17 attached by screw 20 to the supporting plate 14, the water passage cover 18 is fixed in position with a suitable amount of pressure applied thereto, whereby water passage 15 is effectively sealed. In the present embodiment, the recessed portions defining water passage 15 are formed in the base member 17. However it should be noted that it would be equally possible to form these recessed portions in water passage cover 18, to thereby form water passage 15, or to form the recessed portions partly in the base member 17 and partly in the water passage cover 18. It is preferably to form the water passage cover 18 of silicon rubber, since this material has a high resistance to heat and provides thermal insulation. This serves to prevent overheating of water passage 15 as a result of heat transfer from soleplate 2, and hence ensures a smooth flow of steam through water passage 15 by preventing the possiblity of vapor lock occurring therein. Numeral 21 denotes a cover formed from synthetic resin, which covers the upper face of the soleplate 2, and serves to prevent the water tank 5 and the main body 4 of the iron (fixedly attached to cover 21) from being raised to an excessively high temperature. As a result of this heat insulation effect produced by the synthetic resin cover 21, it is possible to form the main body 4 of the iron and also the water tank 5 from a material which has a comparatively low resistance to high temperature, such as a thermoplastic resin. In this way, the overall weight of the steam iron can be made low, and it is possible to manufacture the iron at low cost. In addition, due to the fact that the water tank 5 can be formed from a transparent material, the user can readily see the level of water within water tank 5.

Figure 2:
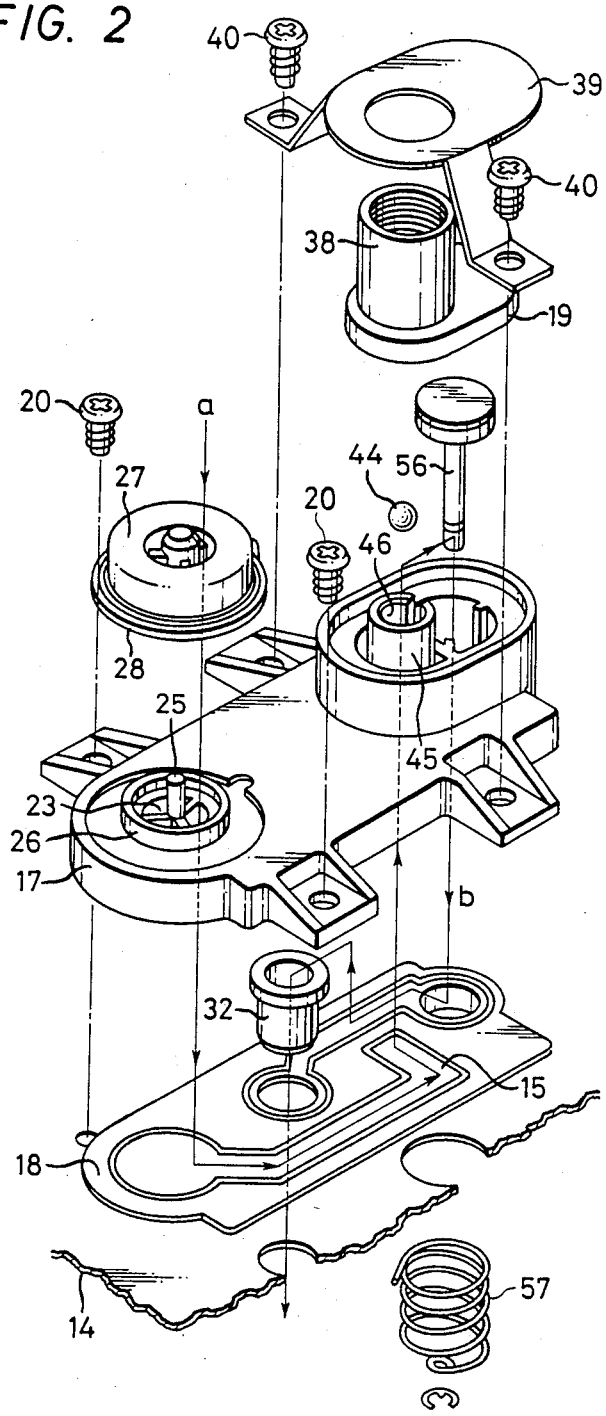
FIG. 2 is an exploded view of components of a water passage in the embodiment of FIG. 1.

The cover 21 is fixedly attached to soleplate 2 through the intermediary of support plate 14 by screws 22, with a space being left between the cover 21 and soleplate 2, in which water passage 15 is disposed. Reference numeral 23 denotes an inlet aperture of water passage 15, which is positioned opposite and below the base of water tank 5. When the water tank 5 is attached to the main body 4 of the iron, the inlet aperture 23 is positioned communicating with an aperture 24 which is formed in the base of water tank 5. A central protrusion 25 is positioned within inlet aperture 23, as illustrated in FIG. 2, which faces aperture 24 of water tank 5. A peripheral ridge 26 is formed around the periphery of aperture 23, surrounding this protrusion 25. A packing member 27 is mounted over aperture 23, and serves to seal this aperture when water tank 5 becomes coupled to water passage 15. A flange 28 is formed on packing member 27, shaped such that the packing member 27 is fixedly attached to base member 17 when the the packing member is positioned to cover aperture 23.

When the water tank 5 is attached to the main body 4 of the steam iron, the protrusion 25 presses against a valve member 30 which is attached within water tank 5, and thereby opens the aperture 24. With water tank 5 removed from the steam iron, aperture 24 is held sealed closed, by the action of a spring 29 acting on valve member 30.

The water passage 15 leads from water tank 5 to an outlet aperture 31, which communicates with a nozzle 32, having a small-bore aperture 33 formed therein leading to steam generating chamber 7. This small-bore aperture 33 serves to limit the rate at which water flows into steam generating chamber 7 to a level such that the water will be immediately vaporized therein.

Reference numeral 34 denotes a pump mechanism which is mounted, with the longitudonal axis thereof disposed vertically, on the main body 4 of the iron, over water passage 15. The pump mechanism 34 is made up of a cylinder 35 which is formed integrally with the main body 4 of the iron and a piston 36 which is slidable within cylinder 35, together with an operating pushbutton 37 constituting an external operating member, for manual actuation of piston 36. The operating pushbutton 37 is positioned to protrude outward from handle 3, towards the front end of handle 3, so that the pushbutton can easily be depressed by the user while gripping handle 3. The lower end of cylinder 35 is inserted within a tubular portion 38 of water passage cover 19, whereby the cylinder 35 is sealed in a manner providing communication with water passage 15.

Reference numeral 39 denotes an attachment member for attaching the water passage cover 19 to the base member 17. The attachment member 39 is fixedly attached to the support plate 14, and to the base member 17, by means of screws 40. Reference numeral 41 denotes a packing member which is fixedly attached to piston 36, and which fits closely within the interior of cylinder 35. A compression member 42 consisting of a coil spring is attached to the lower end of piston 36, with the lower end thereof inserted within water passage 15. A ball 44, serving as a ball valve member, is positioned between the lower end of compression member 42 and a flow inlet aperture 43 which is positioned immediately below the lower end of compression member 42. The ball valve member 44 is formed of a plastic material having low specific gravity, so that it will float upwards when water flows through water passage 15 into cylinder 35 as a result of piston 36 being pulled upwards, without blocking this flow. A tubular partition 45, having a vertically extending slot cut out therefrom as shown in FIG. 2, surrounds a portion 46 of water passage 15 as illustrated in FIG. 2, with this portion 46 extending the water passage 15 to the lower end of cylinder 35. The lower end of this portion 46 is formed with a smaller internal diameter than the diameter of ball valve member 44, to prevent ball valve member 44 from escaping through that lower end, while permitting ball valve member 44 to move freely in the interior of tubular partition 45 between the inlet aperture 43 and the compression member 42, as is clear from FIG. 1. Springs 47 and 48 are provided as shown, coupled to piston 36 such as to return piston 36 to its original position after it has been depressed, and are clamped by a retaining plate 49. Springs 47 and 48 are coupled directly in series with one another, between piston 36 and the top end of cylinder 35. Spring 48 has a substantially higher degree of stiffness than spring 47, i.e. more force must be exerted to compress spring 48 than spring 47, and the top end of spring 48 bears against the operating pushbutton 37. Thus, when operating pushbutton 37 is pushed downward, the resultant downward movement of the piston 36 acts to compress spring 47 until it has become fully compressed. Further downward actuation of operating pushbutton 37 will result in compression of spring 48. However since spring 48 exerts substantially greater resistance to this compression than spring 47, the user is immediately made aware that operating pushbutton 37 has been depressed by a specific amount. In this embodiment, as described in the following, depression of the operating pushbutton 37 from the uppermost position thereof until the latter-mentioned increased resistance occurs will result in generation of a surge of steam. Further actuation of operating pushbutton 37 from that position will result in the iron being set in a dry ironing mode of operation. Hence, the restraint mechanism constituted by springs 47 and 48 is a valuable feature with regard to enhancing the convenience and ease of operation of a steam iron having a steam urge generation capability and having a single operating member for controlling both generation of surges of steam and also selection of the dry ironing mode and steam ironing mode.

The operating pushbutton 37 is mounted in a handle cover 50 which is attached at the front end of handle 3. Operating button 37 is movable vertically within a guidance channel 51, which contains a conventional type of ratchet/spline mechanism (not shown in the drawings) whereby the operating button 37 can be set into either of two stable vertical positions as required, with operating pushbutton 37 being alternately set into each of these positions by successive actuations thereof. Such a ratchet/spline mechanism is well known in the art, so that no details will be given herein.

Reference numeral 52 denotes a temperature-sensitive cut-off unit which is built into a part of water passage 15, and acts to open and close water passage 15, being positioned below the lower end of flow inlet aperture 43 described above. The temperature-sensitive cut-off unit 52 includes a dish-shaped bimetallic member 55 which is positioned within a space 54 formed in the soleplate 2, and is covered by a cover 53. The position of temperature-sensitive cut-off unit 52 is close to the steam generating chamber 7, but external thereto. The temperature-sensitive cut-off unit 52 also includes a valve member 56 of elongated shape which is coupled to bimetallic member 55 to be moved vertically thereby, with the upper end of valve 56 protruding into the water passage 15. The temperature-sensitive cut-off device 52 responds to an increase in the temperature if soleplate 2 is above a specific level by snapping into an upward stable position, as illustrated in FIG. 1, in which water passage 15 is held open and in which a spring 57 is compressed. In this condition, the temperature-sensitive cut-off unit responds to a decrease in the temperature of soleplate 2 below a specific value by snapping into a downward position, as a result of force exerted by the spring 57, in which valve member 56 acts to close water passage 15 and thereby prevent water from reaching steam generating chamber 7, so allowing the temperature of soleplate 2 to rise to a sufficiently high level to produce immediate vaporization of water entering the chamber. In this way, temperature-sensitive cut-off unit 52 serves to hold the temperature of soleplate 2 at a stable level, which ensures immediate vaporization of water entering the steam generating chamber 7.

Reference numeral 58 denotes a temperature adjustment knob whereby the user can set the temperature of soleplate 2 to a desired value, which is connected to a thermostat mounted on soleplate 2 (not shown in the drawings) through a coupling member 59 and an adjustment device 60. Generally speaking, the range of temperature adjustment will be from approximately 80° C. to 200° C.

Reference numeral 62 denotes a water supply aperture, for filling the water tank 5 with water. A cover 61 is slidably mounted on water tank 5 at the front end thereof. Portions of water tank 5 on the left and right sides of the water supply aperture 62 extend towards the rear of the steam iron, i.e. with a U-shaped configuration as viewed in plan. Part of the interior of the main body 4 of the iron is shaped to fit closely within this U-shaped portion of water tank 5, enabling the water tank 5 to be readily attached on or removed from the main body 4 of the iron. Normally, the water tank is held retained on the main body 4 by a locking mechanism (not shown in the drawings). This locking mechanism is released by depressing a pushbutton 63, whereupon water tank 5 can be removed from the steam iron.

Figure 5:
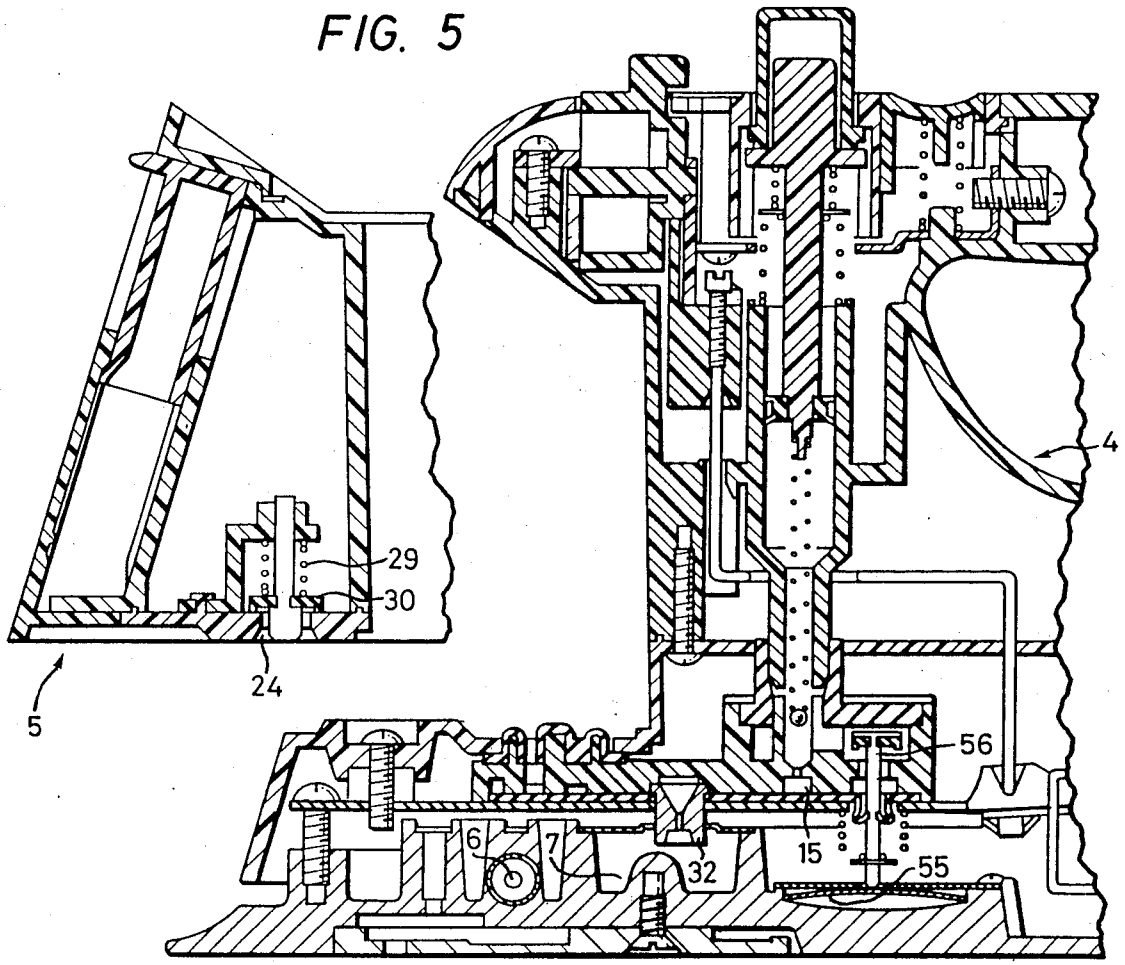
FIG. 5 is a cross-sectional view of a part of the embodiment of FIG. 1, showing the water tank removed from the main body of the iron.

A detailed description will now be given of important components of the steam iron embodiment having the configuration described above, referring first to FIG. 5. This shows the condition of the present embodiment with the water tank 5 removed from the main body 4 of the iron. The aperture 24 formed in the base of water tank 5 is closed by by valve 30, in this condition, thereby preventing leakage of water. It is possible to leave the steam iron with power applied, in this state, while water tank 5 is separated in order to be filled with water. When this temperature of soleplate 2 rises, in such a case, until the steam generating chamber 7 reaches a temperature at which water supplied thereto from nozzle 32 is immediately vaporized, then bimetallic member 55 rapidly snaps into the upward position thereof. Valve member 56 thereby protrudes into and hence opens water passage 15. When the water tank 5 is subsequently again attached on the main body 4 of the iron, to restore the condition shown in FIG. 1, then communication is again established between the water tank 5 and the steam generating chamber 7 through water passage 15. Specifically, when water tank 5 is mounted on the steam iron, valve member 30 is pushed upward against the resistance of spring 29, whereby aperture 24 is opene.

Figure 3:
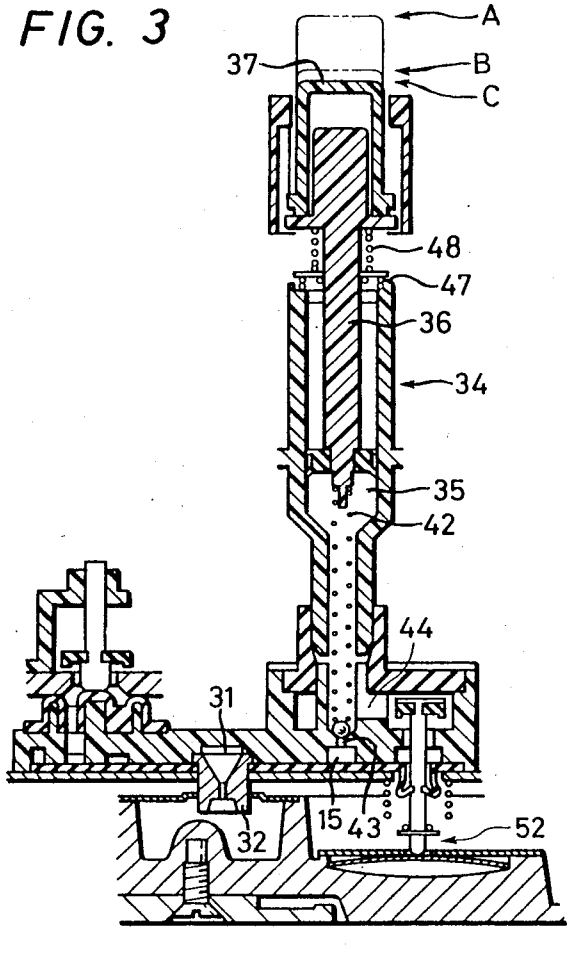

FIG. 2 is a diagram for assistance in describing the flow of water in the present embodiment. In the normal steam ironing mode of operation, the operating pushbutton 37 is left set in the uppermost position thereof (position A in FIG. 3), with compression member 42 pulled upward so that ball valve 44 is left free to move within portion 46 of water passage 15. In this operating condition, water flows from the water tank 5 along the direction indicated by arrow a, through aperture 24, around the periphery of protrusion 25, and through inlet aperture 23 of water passage 15. The water then passes along water passage 15 and pushes the ball valve member 44 upward, to then flow through aperture 43 and enter portion 46, which is surrounded by tubular partition 45 as described hereinabove, and hence enters the lower end of cylinder 35. If the temperature of the steam generating chamber 7 is sufficiently high to ensure that water supplied thereto will be immediately vaporized, then the temperature-sensitive cut-off unit 52 will open water passage 15 so that water then flows from portion 46 of water passage 15, through the vertical slot formed in tubular partition 45 along the direction indicated by arrow b, to the nozzle 32 and through the small-bore aperture 33 formed therein, into steam generating chamber 7 to be vaporized in a stable manner.

The above process describes the normal steam ironing mode of operation. While ironing is being carried out in this mode, the user can cause a surge of steam to be produced from the soleplate 2, or execute changeover to the dry ironing mode of operation, by appropriate actuation of the operating pushbutton 37. These operations will be described with reference to the cross-sectional view of FIG. 3. Changeover from the steam ironing mode of operation to the dry ironing mode of operation is accomplished by moving operating pushbutton 37 from position A to position B. When this is done, piston 36 and compression member 42 are pushed downward together, whereby the ball valve member 44 (which is normally pushed upward by the flow of water through water passage 15) is pushed downward by compression member 42, into flow inlet aperture 43. The flow of water through water passage 15 is thereby interrupted. When operating pushbutton 37 is first moved downward from uppermost position A, spring 47 is compressed, until operating pushbutton 37 reaches position B. At this point, resistance to further depression of operating pushbutton 37 will begin to be exerted by spring 48, so that a substantially increased amount of force must be applied by the user to operating pushbutton 37 in order to move the pushbutton further downward into position C. If this is done, and operating pushbutton 37 is then released, operating pushbutton 37 will be rotated and then retained in position B by the ratchet/spline mechanism referred to hereinabove. The dry ironing mode of operation is thereby established, with water passage 15 held closed by ball valve member 44.

Subsequently, the user can restore the steam ironing mode of operation by depressing operating pushbutton 37 into position C, then releasing the pushbutton, which will now return to position A. Ball valve member 44 is thereby released, ceasing to block the flow inlet aperture 43 of water passage 15. Water is thus again supplied through water passage 15 to the steam generating chamber 7, i.e. the steam ironing mode of operation is restored.

In this condition, generation of a surge of steam from soleplate 2 is performed as follows. Since cylinder 35 communicates with water passage 15, the cylinder is held filled with water during normal steam ironing operation, i.e. with operating pushbutton 37 at position A. If operating pushbutton 37 is depressed from the A to the B position, then ball valve member 44 will be forced into aperture 43, to thereby block water passage 15 such as to prevent reverse flow of water through aperture 43 towards water tank 5. A large quantity of water will then be expelled from cylinder 35 passing from cylinder 35 to flow through the vertical slot formed in tubular partition 45, to then flow along the path indicated by arrow "b" in FIG. 2 as described above, and forced through outlet aperture 31 of water passage 15 and hence through small aperture 33 of nozzle 32, into the steam generating chamber 7 to be rapidly vaporized therein. A surge of steam is thereby ejected through apertures 1 in soleplate 2 onto the material which is being ironed. If operating pushbutton 37 is then released, it will return from position B to position A by the action of spring 47, and water will thereby be drawn into the interior of cylinder 35. At the same time, ball valve member 44 will be released, permitting water to flow at a regulated rate into steam generating chamber 7, for normal steam ironing operation. In this way the user can generate a surge of steam at any time, in the steam ironing mode of operation, simply by depressing operating pushbutton 37 into the B position. Successive actuations of operating pushbutton 37 from the A to B positions can be repetitively performed if it is necessary to generate large amounts of steam.

If on the other hand operating pushbutton 37 is pushed further from the B position into the C position, against the increased spring force described hereinabove, then the dry ironing mode of operation will be established, and held fixed.

Thus the user can select the steam ironing mode of operation, steam surge generation, or the dry ironing mode of operation as required in a very convenient manner, simply by actuating operating pushbutton 37.

It can be understood from the above that the valve mechanism based on valve member 44 serves both to interrupt the flow of water from passage 15 into steam generating chamber 7, when the dry ironing mode is established, and also to prevent a reverse flow of water from cylinder 35 of the pump mechanism back to the water tank through water passage 15, when the pump mechanism is actuated to generate a surge of steam.

Figure 4:
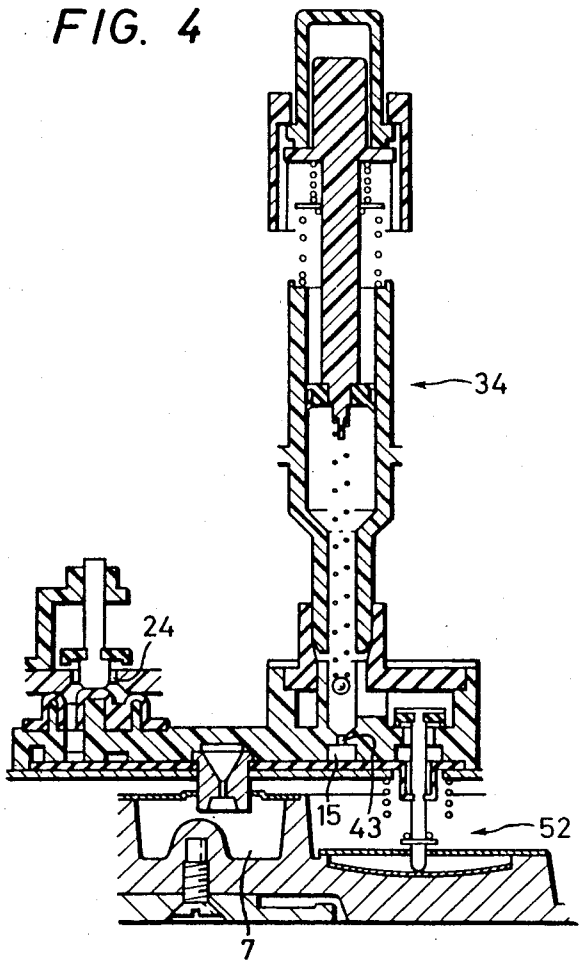
FIG. 3 and FIG. 4 are cross-sectional views showing details of the water passage and a pump mechanism in the embodiment of FIG. 1, with FIG. 3 showing the condition of the pump mechanism when the steam iron is set in a dry ironing mode of operation and FIG. 4 showing the condition of the pump mechanism when the water passage is closed by the action of a temperature-sensitive cut-off unit.

If operating pushbutton 37 is actuated several times in succession in order to produce large volumes of steam, by repetitively pumping water into steam generating chamber 7, then if the temperature-sensitive cut-off unit 52 were not incorporated there would be a danger of the temperature within steam generating chamber falling below that at which the incoming water is immediately vaporized. This would result in hot water being ejected from soleplate 2 onto the material being ironed. However with the present embodiment, the temperature-sensitive cut-off unit 52 acts to immediately block the flow of water through water passage 15 into steam generating chamber 7 when such an excessive temperature drop of steam generating chamber occurs, due to excessive steam surge operation by the user within a short period. FIG. 4 shows the manner in which temperature-sensitive cut-off unit 52 acts to close water passage 15 in such a case. This closed condition of water passage 15 by temperature-sensitive cut-off unit 52 will also of course be established after the iron is first switched on, and will continue until the soleplate 2 has reached a sufficiently high temperature for evaporation of water in steam generating chamber 7.

With a steam iron according to the present invention, as described hereinabove with reference to the preferred embodiment, a pump mechanism is incorporated communicating with a water passage, whereby water can be supplied to a steam generating chamber in quantities suitable for normal steam generation operation and steam surge generation operation respectively. Only a single operating member is required to control changeover between normal steam generation operation, dry ironing operation, and steam surge generation operation. Thus, such a steam iron is extremely simple and convenient to utilize. Also, the spring restraint mechanism formed by springs 47 and 48 serves to eliminate the danger that the user, during normal steam ironing operation, might accidentally lock the operating member in the position for dry ironing operation (e.g. position C in FIG. 3) as a result of momentary inititiation of a surge of steam (e.g. by actuation to position B in FIG. 3). This spring restraint mechanism thereby facilitates the generation of successive surges of steam.

Furthermore, due to that fact that the water tank is removably mounted on the body of the iron, with the water passage and the pump mechanism being contained within the body rate rather than within or below the water tank as is described in prior art patents, a maximum of space is made available to accommodate water tank, so that the storage capacity of the water tank can be maximized. In addition, due to the positioning of the water passage directly below the water tank, a smooth flow of water from the water tank to the steam generating chamber is ensured. Also, since the pump mechanism is mounted directly above the water passage, the pump mechanism can readily be formed integrally within the main body of the iron.

Furthermore, incorporation of a temperature-sensitive cut-off unit as in the preferred embodiment serves to eliminate the danger that water rather than steam may be ejected from the iron, due to operation with the soleplate at an insufficiently high temperature.

Although the present invention has been described in the above with reference to a specific embodiment, it should be noted that various changes and modifications to the embodiment may be envisaged, which fall within the scope claimed for the invention as set out in the appended claims. The above specification should therefore be interpreted in a descriptive and not in a limiting sense.

What is claimed is:

1. A steam iron having a steam surge generating capability, comprising:

a soleplate provided with a heater element;

a steam generating chamber disposed upon said soleplate;

a main body attached to an upper portion of said soleplate;

a water tank for storing water to be supplied to said steam generating chamber;

a plurality of members mounted above said soleplate to form a water passage for supplying water from said water tank to said steam generating chamber at a regulated rate of flow suitable for a normal steam generation mode of operation of said steam iron;

a pump mechanism communicating with said water passage, operable to supply a momentary surge of water to said steam generating chamber, said pump mechanism comprising a cylinder and a piston slidably movable within said cylinder;

an external operating member coupled to said pump mechanism for moving said piston through a fixed range of movement;

means defining a flow inlet aperture communicating between said water tank and said water passage;

means defining a flow outlet aperture communicating between said water passage and said steam generating chamber;

reverse flow prevention valve means for preventing a reverse flow of water through said water passage into said water tank, operable in response to actuation of said pump mechanism, and;

restraining means coupled to said operating member of said pump mechanism, for producing a restraining force acting against movement of said operating member at a specific position within said fixed range of movement of said piston, said restraining means comprising at least two springs coupled in series to said operating member and having respectively different values of stiffness.

2. A steam iron having a steam surge generating capability, comprising:

a soleplate provided with a heater element;

a steam generating chamber disposed upon said soleplate;

a main body attached to an upper portion of said soleplate;

a water tank for storing water to be supplied to said steam generating chamber;

a plurality of members mounted above said soleplate to form a water passage for supplying water from said water tank to said steam generating chamber at a regulated rate of flow suitable for a normal steam generation mode of operation of said steam iron;

a pump mechanism communicating with said water passage, operable to supply a momentary surge of water to said steam generating chamber, said pump mechanism comprising a cylinder and a piston slidably movable within said cylinder;

an external operating member coupled to said pump mechanism for moving said piston through a fixed range of movement;

means defining a flow inlet aperture communicating between said water tank and said water passage;

means defining a flow outlet aperture communicating between said water passage and said steam generating chamber; and reverse flow prevention valve means for preventing a reverse flow of water through said water passage into said water tank, operable in response to actuation of said pump mechanism;

in which said water tank is removably mounted on said main body of said steam iron and said water passage and said pump mechanism are disposed on said main body of said steam iron.

3. A steam iron according to claim 2, wherein:

said water passage is disposed within a spaced formed between a top face of said soleplate and a base portion of said water tank, and in which said pump mechanism is disposed directly above said water passage, communicating therewith.

4. A steam iron according to claim 2, further comprising:

valve means mounted on said water tank, said valve means opening to provide communication between said water tank and said water passage when said water tank is mounted on said steam iron, and closing when said water tank is removed from said steam iron to thereby prevent leakage of water from said water tank.

5. A steam iron having a steam surge generating capability, comprising:

a soleplate provided with a heater element;

a steam generating chamber disposed upon said soleplate;

a main body attached to an upper portion of said soleplate;

a water tank for storing water to be supplied to said steam generating chamber;

a plurality of members mounted above said soleplate to form a water passage for supplying water from said water tank to said steam generating chamber at a regulated rate of flow suitable for a normal steam generation mode of operation of said steam iron;

a pump mechanism communicating with said water passage, operable to supply a momentary surge of water to said steam generating chamber, said pump mechanism comprising a cylinder and a piston slidably movable within said cylinder;

an external operating member coupled to said pump mechanism for moving said piston through a fixed range of movement;

means defining a flow inlet aperture communicating between said water tank and said water passage;

means defining a flow outlet aperture communicating between said water passage and said steam generating chamber;

reverse flow prevention valve means for preventing a reverse flow of water through said water passage into said water tank, operable in response to actuation of said pump mechanism; and a temperature-sensitive cut-off unit acting to enable a flow of water through said water passage into said steam generating chamber when a temperature within said steam generating chamber attains a sufficiently high value for evaporation of water therewithin, and acting to block said flow of water through said water passage into said steam generating chamber when said temperature is below said sufficiently high value.

6. A steam iron having a steam surge generating capability, comprising:

a soleplate provided with a heater element;

a steam generating chamber disposed upon said soleplate;

a main body attached to an upper portion of said soleplate;

a water tank removably mounted on said main body, for storing water to be supplied to said steam generating chamber;

a plurality of members mounted above said soleplate to form a water passage for supplying water from said water tank to said steam generating chamber at a regulated rate of flow suitable for a normal steam generation mode of operation of said steam iron;

a pump mechanism communicating with said water passage, operable to supply a momentary surge of water to said steam generating chamber, said pump mechanism comprising a cylinder and a piston slidably movable within said cylinder;

an external operating member coupled to said pump mechanism for moving said piston through a fixed range of movement;

means defining a flow inlet aperture communicating between said water tank and said water passage;

means defining a flow outlet aperture communicating between said water passage and said steam generating chamber;

reverse flow prevention valve means for preventing a reverse flow of water through said water passage into said water tank, operable in response to actuation of said pump mechanism; and restraining means coupled to said operating member of said pump mechanism, for producing a restraining force acting against movement of said operating member at a specific position within said fixed range of movement of said piston, said restraining means comprising at least two springs coupled in series to said operating member and having respectively different values of stiffness.

* * * * *